US006048253A

United States Patent [19]

Larsen

[11] Patent Number: 6,048,253

[45] Date of Patent: Apr. 11, 2000

[54] SUPPORT APPARATUS

[76] Inventor: Marilyn M. Larsen, 15313 Gosford Rd., Bakersfield, Calif. 93313-9613

[21] Appl. No.: 09/092,653

[22] Filed: Jun. 5, 1998

Related U.S. Application Data

[60] Provisional application No. 60/048,684, Jun. 5, 1997.

[51] Int. Cl.[7] ..... A41C 1/08

[52] U.S. Cl. ..... 450/155; 450/139; 2/44; 2/45

[58] Field of Search ..... 450/122–139, 450/155; 2/44, 45, 310, 312, 338, 237, 221, 76, 92; 602/19; 128/96.1, 99.1, 100.1, 101.1

[56] References Cited

U.S. PATENT DOCUMENTS

| | | | |
|---|---|---|---|
| 2,840,822 | 7/1958 | Ericsson | 450/155 |
| 2,896,634 | 7/1959 | Beder | 450/155 |
| 3,273,563 | 9/1966 | Bonang | 450/155 |
| 3,524,449 | 8/1970 | Peters | 450/155 |
| 4,108,149 | 8/1978 | Castiglia | 450/155 |
| 4,557,268 | 12/1985 | Maddux et al. | 128/96.1 |
| 4,596,253 | 6/1986 | Griffith | 128/100.1 |
| 4,697,592 | 10/1987 | Maddux et al. | 450/155 |
| 4,991,234 | 2/1991 | Greenberg | 2/170 |
| 5,040,526 | 8/1991 | Erickson . | |
| 5,060,639 | 10/1991 | Marcus . | |
| 5,241,704 | 9/1993 | Sydor | 2/44 |
| 5,274,851 | 1/1994 | Simpkins, Sr. et al. . | |
| 5,492,496 | 2/1996 | Walker . | |
| 5,537,690 | 7/1996 | Johnson . | |
| 5,702,286 | 12/1997 | Seering et al. | 450/155 |

FOREIGN PATENT DOCUMENTS

| | | |
|---|---|---|
| 3441876 | 11/1984 | Germany . |

*Primary Examiner*—Gloria M. Hale
*Attorney, Agent, or Firm*—Worrel & Worrel

[57] ABSTRACT

A support apparatus having a main panel constructed of substantially elastic material and dimensioned to be positionable about a portion of the body of a person in supporting relation thereto, such as the protruding region of the abdomen of a pregnant woman; and fasteners operable releasibly to secure the main panel in the supporting relation to provide such support.

9 Claims, 3 Drawing Sheets

SUPPORT APPARATUS

CROSS-REFERENCE TO RELATED APPLICATIONS

This application claims priority under 35 U.S.C. §119(e) with respect to Provisional Patent Application Ser. No. 60/048,684, filed Jun. 5, 1997 by Applicants Marilyn M. Larsen and Sally A. Wood, entitled "MOTHER'S BELLY BAND" ABDOMINAL AND BACK SUPPORT, in the United States Patent and Trademark Office.

STATEMENT REGARDING FEDERALLY SPONSORED RESEARCH OR DEVELOPMENT

Not Applicable.

BACKGROUND OF THE INVENTION

1. Field of the Invention

The present invention relates to a support apparatus and, more particularly, to such a support apparatus which is particularly well suited to providing support to body portions while accommodating and facilitating bodily movement.

2. Description of the Prior Art

Problems associated with bodily support exist for both animals and human beings in that, at certain times and under certain conditions, stresses can develop which interfere with, or otherwise compromise bodily functioning. For example, in both animals and human beings the condition of pregnancy, particularly in the latter stages, creates muscular and other bodily stresses which substantially compromise normal bodily functioning. The stresses involved affect both general bodily comfort as well as mobility. There is a wide variety of other bodily conditions which can also present these and other difficulties. Thus, patients recovering from surgery, the obese, persons with back injuries and a host of other physical conditions can experience such bodily stresses.

The prior art is replete with many types of devices developed for the purpose of assisting in such circumstances. The particular form of such prior art devices has varied to some extent, depending upon the specific condition for which they were designed. For example, in the case of pregnant women and people of either sex who otherwise have protruding abdomens, discomfort in the abdominal area and pain in the lower back is experienced even without attempting normal activities. Attempts to engage in normal activities, such as walking, climbing stairs, carrying light loads, or moving from a sitting, or reclining, position to a standing position, further aggravate the pain and discomfort. In the case of pregnant women, this pain and discomfort is exacerbated during the latter stages of pregnancy.

Prior art efforts to remedy these conditions and to alleviate the associated pain typically involve the use of a support adapted to be worn about a person's back and abdomen. However, such conventional supports which wrap around a person's abdomen are frequently uncomfortable. Furthermore, such conventional back supports do not evenly support the protruding abdomen, or act to stabilize the protruding abdomen, or serve to keep the protruding abdomen properly positioned rather than shifting from side to side as the person moves.

By way of example, U.S. Pat. No. 5,060,639, issued to Marcus on Oct. 29, 1991 discloses a back support adapted to be worn about a person's waist. The back support has a resiliently compressible, flexible elongated back pad, a pair of resiliently compressible, flexible elongated side pads and an elastic and flexible strap. The back pad and side pads are configured and dimensioned to be positioned against the person's lower back and sides. The back pad is filled with a suitable resiliently compressible filler, such as foam, and has stitching therethrough which compresses the filler in different areas and to different degrees. Each of the side pads is attached, at one end, to a respective end of the back pad. The strap releasably interconnects the side pads adjustably to fit the back support about the waist. The strap is bifurcated forming an upper portion and a lower portion so that the portions of the strap can be disposed on the top and bottom of the protruding abdomen. The lower portion of the strap is configured and dimensioned to support, at least partially, the protruding abdomen. The upper portion of the strap is configured and dimensioned to stabilize the position of the protruding abdomen. The back support can include a resiliently elastic cover extending between and connecting the upper and lower portions of the strap. The lower portion of the strap provides the majority of the support for the abdomen, but applies a significant resulting force to the lower back. This device produces uneven support across the abdomen, resulting in unequal weight distribution placed on the support and a significant downward force placed on the lower back.

Another representative prior art patent is U.S. Pat. No. 5,492,496 issued to Walker on Feb. 20, 1996. This patent is directed to a garment intended to provide comforting support to the abdomen when the person is in a reclining position. The garment is particularly adapted for use by pregnant women, but can also be worn by others in need of abdominal support. The garment includes a non-padded, expandable front panel attached to two side panels constructed of layered padding encased in soft material. The side panels extend into back flaps that secure the garment at the back. The back flaps include adjustable fasteners. The layered padding in the side panels provides more cushioning support toward the front, or anterior, portion of the abdomen. The garment is designed for use by pregnant women only when they are attempting to rest, sleep, or exercise while in the reclining position. The limitations of such devices, since they provide no assistance while engaging in normal activities, is apparent.

Therefore, it has long been known that it would be desirable to have a support apparatus which was adaptable for usage in a wide variety of operative environments and including usage on both animals and human beings; which was particularly well suited to usage by human beings in the support of body portions such as a protruding abdomen and, more specifically, by pregnant women; which accommodated and facilitated bodily movement during normal activities; which was comfortable during use over long periods of time without burdening the person wearing the apparatus or any particular portions of the body; and which was otherwise entirely successful in achieving its operational objectives.

SUMMARY OF THE INVENTION

Therefore, it is an object of the present invention to provide an improved support apparatus adapted for usage in a wide variety of operative environments.

Another object is to provide such a support apparatus which is fully adaptable for use on both animals and human beings, as well as to be employed in the support of various body portions under a wide variety of conditions.

Another object is to provide such a support apparatus which can be worn for long periods of time without discomfort while being fully effective in achieving its operational objectives.

Another object is to provide such a support apparatus which provides both support and stability to the body portion with respect to which it is used during normal activities.

Another object is to provide such a support apparatus which possesses the ability to conform to the body portion to which it is applied so as to afford the optimum support while ensuring considerable comfort even when worn over extended periods of time.

Another object is to provide such a support apparatus which is inexpensive to manufacture and sell while having a long operational life.

Another object is to provide such a support apparatus which is particularly well suited to use by pregnant women in support of the protruding abdomen through the entire period of gestation and without interfering with the normal development of the fetus.

Another object is to provide such a support apparatus which is adaptable, over time, to the enlargement and change in configuration of the abdomen of the pregnant woman during the entire period of gestation.

Further objects and advantages are to provide improved elements and arrangements thereof in an apparatus for the purpose described which is dependable, economical, durable and filly effective in accomplishing its intended purposes.

These and other objects and advantages are achieved, in the preferred embodiment of the present invention, in a support apparatus for use in providing support for a work object, the support apparatus having a body member constructed of substantially resilient, expansible fabric; and a fastener mounted on the body member operable releasibly to secure the body member on the work object in an operational position so as to provide support for the work object.

DETAILED DESCRIPTION OF THE INVENTION

Figure 1:
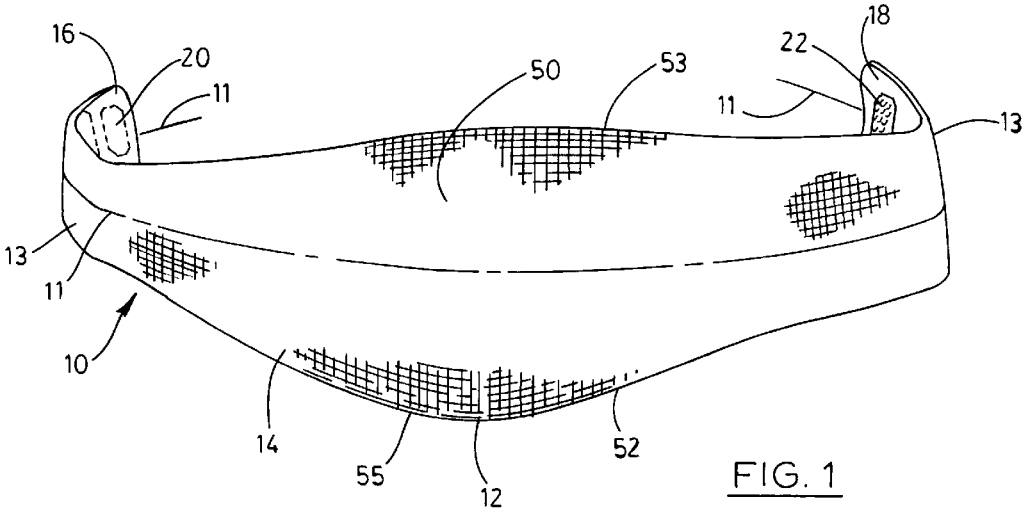
FIG. 1 is a front elevation of the first embodiment of the support apparatus of the present invention shown in an attitude for purposes of display and without being worn.

Referring more particularly to the drawings, the support apparatus of the present invention is generally indicated by the numeral 10 in FIG. 1. The support apparatus is, very roughly, rectangular in shape oriented along a longitudinal axis 11. The support apparatus can be viewed as having a central support portion 12 and opposite lateral support portions 13. The support apparatus, as will hereinafter be discussed in greater detail, is preferably constructed of a suitable resilient woven or other suitable fabric 14.

The support apparatus 10 terminates at two opposing, complementary ends shown in the drawings as first terminal end 16 and second terminal end 18. As will hereinafter be discussed in greater detail, in the installed or attached position, the first and second terminal ends overlap as suggested in FIG. 4. The greatest width of the support apparatus 10 is at the central support portion 12. As may best be visualized in FIGS. 1, 2 and 5, the support apparatus tapers in substantially equal degree from the central support portion 12 in opposite directions toward, respectively, the first and second terminal ends 16 and 18.

The fabric 14 of the support apparatus 10 is preferably a woven, resilient and opaque material. The specific fabric which is employed can be selected according to a variety of factors, including, but not limited to, cost, ease of manufacture, wearing comfort, expandability, resiliency, and support. In the preferred embodiment, the fabric is an elastic material commonly known as "spandex." However, any other suitable material which provides sufficient resiliency and uniform support when stretched or expanded can be employed as the fabric 14.

These characteristics permit the support apparatus 10 to be expanded about and cover the specific body portion intended, such as the protruding area of the abdomen, delivering uniform support thereto. While the support apparatus can be constructed in any suitable size and configuration, in the illustrative embodiment, the support apparatus has, in an unstretched condition, a length of forty-five inches (45") to forty-nine inches (49") and a width of twelve inches (12") to thirteen inches (13"). It will be understood, however, that the support apparatus can be manufactured in various sizes and shapes to accommodate different body portions and different size requirements and conditions of the persons intending to wear the support apparatuses. Alternatively, the sizing method can simply involve the use of predetermined small, medium, large, extra large sizes and/or other sizes, based upon predetermined criteria.

Figure 2:
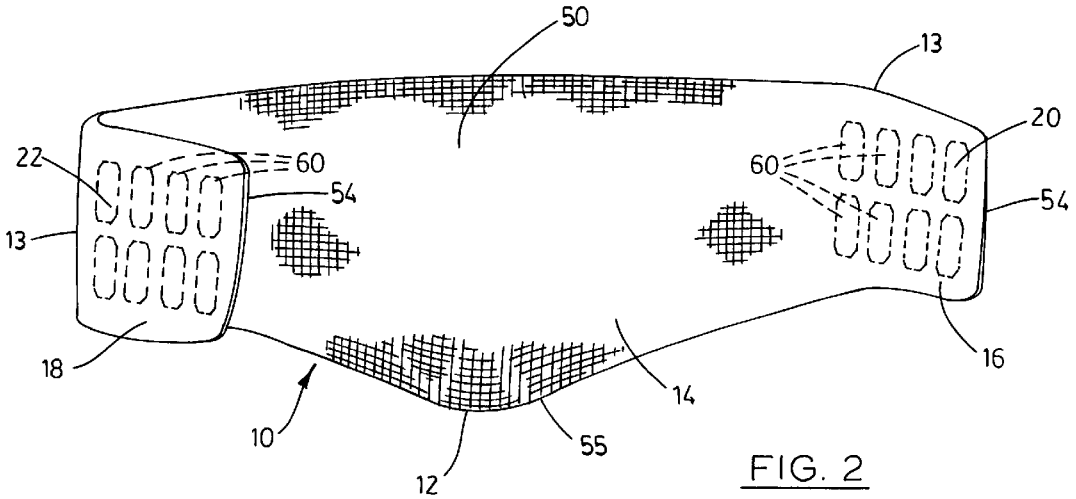
FIG. 2 is a rear elevation of the support apparatus shown in FIG. 1.

The support apparatus 10 has a first set of fasteners 20 mounted on the lateral support portion 13 on the left, as viewed in FIG. 1, and the right, as viewed in FIG. 2. The support apparatus has a second set of fasteners 22 mounted on the lateral support portion 13 on the right, as viewed in FIG. 1, and the left, as viewed in FIG. 2. The specific form of the first and second fasteners employed can be of any suitable type. Thus, for example, the first and second set of fasteners can be "VELCRO" hook and loop fasteners, rivets, buttons, snaps, or any other suitable fasteners. In the preferred embodiment, "VELCRO" hook and loop sets of fasteners are employed. Each fastener within each set, in the preferred embodiment, is a patch which is attached by any suitable means, such as adhesively or by stitching, to its respective lateral support portion 13. The patches are preferably arranged in the predetermined patterns shown in the drawings. As shown in FIG. 2, a plurality of the patches of the first and second set of fasteners are attached in a set to one side of the lateral support portion 13 and another plurality of the patches are attached in a set to the opposite side of the opposite lateral support portion 13. The patches of the respective sets are attached so that they are aligned in predetermined patterns and relative to the longitudinal axis 11 of the support apparatus.

Figure 5:
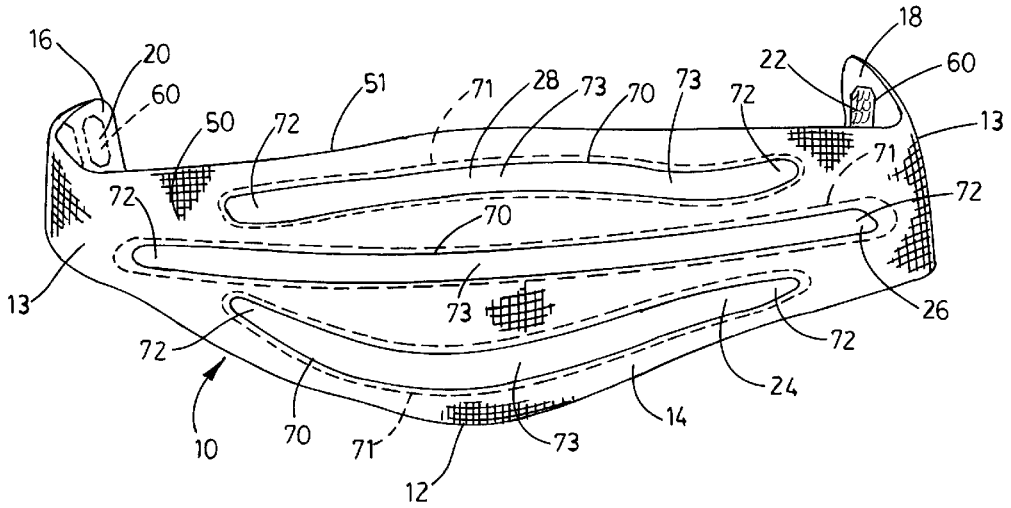
FIG. 5 is a front elevation of the support apparatus of the second embodiment of the present invention shown in an attitude equivalent to the first embodiment of the invention shown in FIG. 1.

A second embodiment of the support apparatus 10 of the present invention is shown in FIG. 5. In this second embodiment the support apparatus has a lower supplementary support panel generally indicated by the numeral 24; a central supplementary support panel generally indicated by the numeral 26; and an upper supplementary support panel generally indicated by the numeral 28. The material from which the supplementary support panels 24, 26 and 28 are made is preferably expandable and resilient, but less resilient and expandable than the fabric 14 of the support apparatus 10. The reduced resiliency and expansion of the supplementary support panels 24, 26 and 28 provides additional support and control and allows the body portion supported not to protrude or sway to the degree to which it otherwise would. The supplementary support panels are preferably mounted on the fabric 14 by stitching, or by any other suitable means of attachment.

In still another embodiment of the support apparatus 10 of the present invention, the lower, central and upper supplementary support panels 24, 26 and 28, respectively, are adapted releasibly to be mounted in position on the fabric 14 in any desired positions. Such releasible fastening can be accomplished using "VELCRO" type hook and loop fasteners or any other suitable fastening means which permits the supplementary support panels to be secured on the fabric 14 in selected positions for the optimum support and control. This permits the user, or medical personnel, to adjust the support apparatus to the particular condition of the user for the optimum benefit even as the user's condition may change over time. Thus, the amount of support and control provided to the abdomen and/or lower back can be adjusted as may be desired.

Returning then to the support apparatus 10 of the present invention in all of its embodiments shown and described herein, for illustrative convenience it will be understood that the support apparatus, as shown in the drawings can be viewed as having a main panel or body member 50 bounded by a peripheral edge 51. The peripheral edge includes a lower edge 52, an opposite upper edge 53 and opposite lateral edges 54. The lower edge 52 has a protruding portion 55.

The first set of fasteners 20 and the second set of fasteners 22 each include a plurality of fastener panels 60 arranged as previously set forth.

The lower supplementary support panel 24, central supplementary support panel 26 and upper supplementary support panel 28 each have marginal edges 70 which, in the preferred embodiment, are mounted on the fabric 14 of the body member 50 by stitching 71. Each of the supplementary support panels has opposite end portions 72 and contoured portions 73 which can be varied in configuration to achieve the desired effect.

Figure 3:
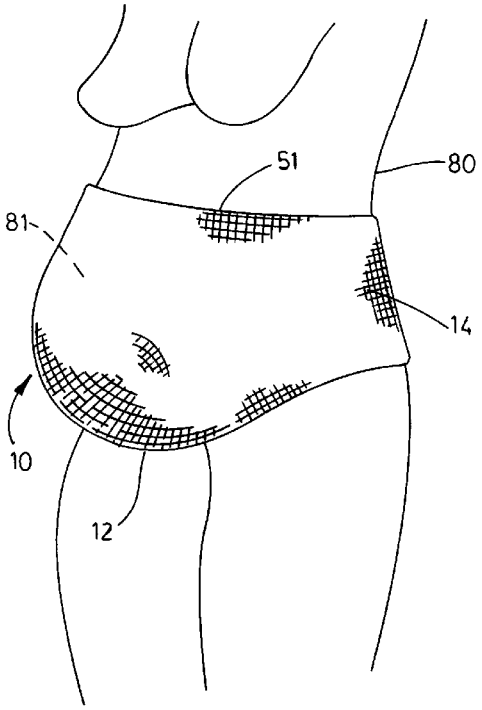
FIG. 3 is a front perspective view of the support apparatus shown in a typical operative environment being worn in an installed position about the abdomen of a pregnant woman.
Figure 4:
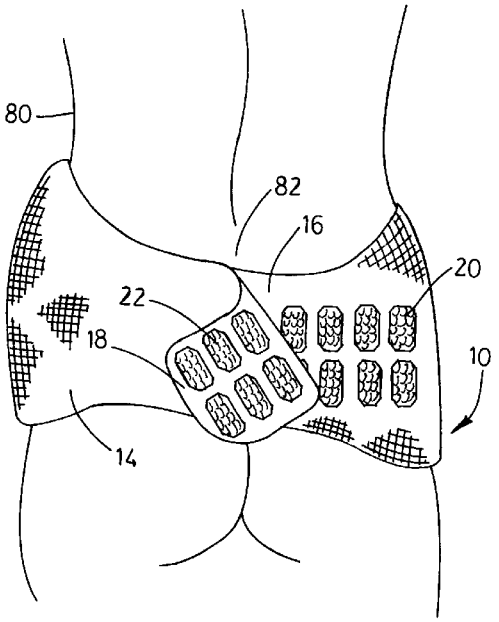
FIG. 4 is a rear perspective view of the support apparatus of FIG. 3 in said installed position of FIG. 3, but with one of the flap portions folded back to expose the fasteners thereof.

For illustrative convenience, the support apparatus 10 is shown in Fig. 3 and FIG. 4 in a representative operative environment in use to provide assistance and support for a pregnant woman 80. The pregnant woman's protruding abdomen is generally indicated by the numeral 81 in FIG. 3 and the pregnant woman's lower back is generally indicated by the numeral 82 in FIG. 4.

OPERATION

The operation of the described embodiments of the subject invention are believed to be clearly apparent and are briefly summarized at this point.

Referring more particularly to FIGS. 3 and 4, the support apparatus 10 is shown in a representative operative environment and one typical for the illustrative embodiments hereof. It will be understood, however, that the support apparatus is adapted for use in a wide variety of operative environments of which the one shown and described herein is merely one example.

As shown in FIG. 3, the support apparatus 10 is deployed in expanded or stretched, covering relation the protruding abdomen 81 of the pregnant woman 80. The support apparatus in the illustrative environment extends from four inches (4") to six inches (6") below the lower margin of the brassiere line to a point generally over the pubic area of the pregnant woman. The central support portion 12 of the support apparatus expands sufficiently to cover the protruding abdomen, resulting in uniform and equal support therefor. This uniform and equal support of the protruding abdomen distributes the weight and downward force of the abdomen equally to the lower back 82 thereby minimizing the effect of the protruding abdomen on the lower back 82.

The first and second sets of fasteners 20 and 22 of the support apparatus 10 are displayed in FIG. 4. As shown therein, one opposing first terminal end 16 is shown folded over the lower back 82 of the pregnant woman making contact with the skin, and revealing the first set of fasteners 20. The opposing second terminal end 18 of the support apparatus is folded over the first terminal end 16 so that the first and second set of fasteners engage to secure the support apparatus in the selected position as shown in FIG. 4. As depicted in FIG. 4 for illustrative convenience, the second terminal end 18 is folded back to expose the first and second sets of fasteners. Adjustments as to the fit and degree of support can be made by repositioning the first and second set of fasteners in selected positions of engagement so as relatively to increase or decrease the amount of tension applied to the body member 50 of the support apparatus and to permit repositioning thereof relative to the abdomen 81, lower back 82 and other portions of the body to accomplish the desired support and control. In this case, as shown in FIG. 4, this repositioning involves adjusting the overlapping opposing end 18 in various selected positions relative to the opposing end 16.

As previously discussed, in the case of the embodiment of the support apparatus 10 shown in FIG. 5, the supplementary support panels 24, 26 and 28 are positioned and contoured to provide additional support and control. In the additional embodiment wherein the supplementary support panels can be selectively positioned as desired, the specific configuration desired can be selected to suit the condition involved and changed over time by the user to adjust to changes in the condition of the person wearing the support apparatus.

Therefore, the support apparatus of the present invention is adaptable for usage in a wide variety of operative environments and including usage on both animals and human beings; is particularly well suited to usage by human beings in the support of body portions, such as a protruding abdomen and, more specifically, to usage by pregnant women; accommodates and facilitates bodily movement during normal activities; is comfortable during use over long periods of time without burdening the person wearing the apparatus or any particular portions of the body; and is otherwise entirely successful in achieving its operational objectives.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. A support apparatus for use in providing support for a work object, such as the body of a human being, animal, or the like, the support apparatus comprising a body member constructed of substantially resilient, expansible fabric and adapted substantially to conform to and support a predetermined portion of the work object; and means mounted on said body member for releasibly mounting said body member on the work object in an operational position substantially coinciding with said predetermined portion of the work object so as to provide support therefor.

2. The support apparatus of claim 1 wherein said body member is of a configuration and size adapted to overlay a portion of the work object in substantially conforming relation thereto in said operational position.

3. The support apparatus of claim 2 wherein said body member has opposite terminal end portions and said mounting means include fasteners mounted on the body member individually adjacent to said terminal end portions in positions permitting the body member to be extended about the work object in said operational position to support said predetermined portion of the work object and placed in releasible engagement with each other releasibly to retain said body member in said operational position.

4. The support apparatus of claim 3 wherein said body member is constructed of a substantially elastic material.

5. The support apparatus of claim 3 wherein said work object is the body of a pregnant woman having a protruding abdomen and a lower back and said operational position is that in which said body member of the support apparatus extends generally about the protruding abdomen of the pregnant woman in resiliently expanded and overlaying relation thereto and said fasteners are in releasible engagement to each other in generally overlaying relation to said lower back of the pregnant woman.

6. The support apparatus of claim 5 including at least one supplementary support panel mounted on the body member so as to be positionable in supporting relation to the protruding abdomen.

7. The support apparatus of claim 6 wherein said supplementary support panel is contoured so as to assist in providing said support.

8. The support apparatus of claim 6 wherein said supplementary support panel can releasibly be mounted on said body member to permit said supplementary support panel to be positioned in a selected position and to permit adjustment of the position and extent of the support provided thereby.

9. The support apparatus of claim 6 including a plurality of said supplementary support panels mounted on the body member in spaced relation to each other so as to be positionable extending generally across said protruding abdomen of the pregnant woman in said operational position.

* * * * *

UNITED STATES PATENT AND TRADEMARK OFFICE

CERTIFICATE OF CORRECTION

PATENT NO. : 6,048,253

DATED : April 11, 2000

INVENTOR(S) : MARILYN M. LARSEN

It is certified that error appears in the above-identified patent and that said Letters Patent is hereby corrected as shown below:

Column 3, line 28, delete "filly" and substitute ---fully---.

Signed and Sealed this

Twentieth Day of February, 2001

Nicholas P. Godici

NICHOLAS P. GODICI

*Acting Director of the United States Patent and Trademark Office*

*Attest:*

*Attesting Officer*